US010415894B2

(12) United States Patent
Abrahamian et al.

(10) Patent No.: US 10,415,894 B2
(45) Date of Patent: Sep. 17, 2019

(54) FIN AND TUBE HEAT EXCHANGER

(75) Inventors: David J. Abrahamian, Williamsville, NY (US); Kevin M. Conroy, Lancaster, NY (US)

(73) Assignee: Ingersoll-Rand Company, Davidson, NC (US)

( * ) Notice: Subject to any disclaimer, the term of this patent is extended or adjusted under 35 U.S.C. 154(b) by 1322 days.

(21) Appl. No.: 11/340,115

(22) Filed: Jan. 26, 2006

(65) Prior Publication Data

US 2007/0169921 A1 Jul. 26, 2007

(51) Int. Cl.
*F28F 1/32* (2006.01)
*F28D 1/053* (2006.01)

(52) U.S. Cl.
CPC ..... *F28F 1/325* (2013.01); *F28D 1/05333* (2013.01); *F28F 2215/08* (2013.01)

(58) Field of Classification Search
CPC ..... F28F 1/325; F28F 1/128; F28F 2215/08; F28D 1/05333; Y10S 165/487; Y10S 165/503
USPC ..... 165/151, 181, 77, 140
See application file for complete search history.

(56) References Cited

U.S. PATENT DOCUMENTS 2,427,336 A * 9/1947 Askin ..... 165/150
2,965,357 A * 12/1960 Modine ..... 165/151
2,983,483 A * 5/1961 Modine ..... 165/74
3,433,300 A * 3/1969 Pasternak ..... 165/151
3,687,194 A * 8/1972 Scholl ..... 165/180
4,300,629 A 11/1981 Hatada et al.
4,434,844 A 3/1984 Sakitani
4,550,776 A * 11/1985 Lu ..... 165/151
4,738,225 A * 4/1988 Juang ..... 122/367.3
5,035,052 A 7/1991 Suzuki et al.
5,099,914 A 3/1992 Reifel
5,168,923 A 12/1992 Sacks
5,170,842 A * 12/1992 Kato et al. ..... 165/151
5,509,469 A 4/1996 Obosu
5,553,663 A * 9/1996 Yu ..... F28F 1/325 165/151
5,692,561 A * 12/1997 Kang et al. ..... 165/151
5,722,485 A * 3/1998 Love et al. ..... 165/151
5,730,214 A 3/1998 Beamer
(Continued)

FOREIGN PATENT DOCUMENTS

DE 10227930 A1 1/2004
JP 55-118596 * 9/1980
JP 03031693 A * 2/1991

OTHER PUBLICATIONS

JP 55118596 Translation.*
(Continued)

*Primary Examiner* — Jon T. Schermerhorn, Jr.
(74) *Attorney, Agent, or Firm* — Taft Stettinius & Hollister LLP

(57) ABSTRACT

In accordance with certain embodiments, a cooler for multiple tube banks features a series of parallel and planar fins that have upstream louvers to direct incoming air through a fin near a first row of tubes and a downstream set of louvers near an adjacent tube row to direct air back through the same fin before the air exits. By way of example, the upstream louvers have the negative slope of the downstream louvers and a constant angle from louver to louver within a bank. A constant length in a section view may be provided.

16 Claims, 5 Drawing Sheets

(56) References Cited

U.S. PATENT DOCUMENTS

| | | | | |
|---|---|---|---|---|
| 5,738,168 | A * | 4/1998 | Patel et al. | 165/151 |
| 5,752,567 | A * | 5/1998 | Obosu | 165/151 |
| 5,915,471 | A | 6/1999 | Kim | |
| 5,927,392 | A * | 7/1999 | Youn et al. | 165/151 |
| 5,975,199 | A | 11/1999 | Park et al. | |
| 6,227,289 | B1 * | 5/2001 | Yokoyama et al. | 165/151 |
| 7,021,370 | B2 * | 4/2006 | Papapanu et al. | 165/151 |
| 7,182,127 | B2 * | 2/2007 | Oh et al. | 165/151 |
| 2005/0016718 | A1 | 1/2005 | Papapanu | |

OTHER PUBLICATIONS

Full Translation of JP 03031693.*
Singapore Written Opinion for Singapore Application No. 200900583-6 dated Nov. 2, 2009.

* cited by examiner

FIN AND TUBE HEAT EXCHANGER

BACKGROUND

The subject invention relates to heat exchangers of the fin-and-tube type with an improved louver configuration.

Fin-and-tube type heat exchangers are well known in the art. These heat exchangers include a number of fins with heat transfer tubes passing therethrough. The fins typically incorporate a number of louvers to redirect and mix the air flow across the fins to increase the heat transfer between the surfaces of the heat exchanger, which include the surfaces of the fins and the outside surfaces of the tubes, and the air flow. One issue that arises when disrupting the air flow is a pressure drop across the fins. A significant increase in the pressure drop across the fins is the penalty paid for the increased heat transfer.

Therefore, there is a need for improved louvered fin designs for fin and tube heat exchangers that improve heat dissipation characteristics while reducing pressure drop in fluid flowing across the fin. Those skilled in the art will better understand the present invention from a review of the preferred embodiment and drawings that appear below and the claims that determine the full scope of the invention.

SUMMARY OF THE INVENTION

In accordance with certain embodiments, a cooler for multiple tube banks features a series of parallel and planar fins that have upstream louvers to direct incoming air through a fin near a first row of tubes and a downstream set of louvers near an adjacent tube row to direct air back through the same fin before the air exits. The upstream louvers can have the negative slopes of the downstream louvers, and a constant angle from louver to louver within a bank can be provided. Moreover, a constant length in a section view is also contemplated.

DETAILED DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
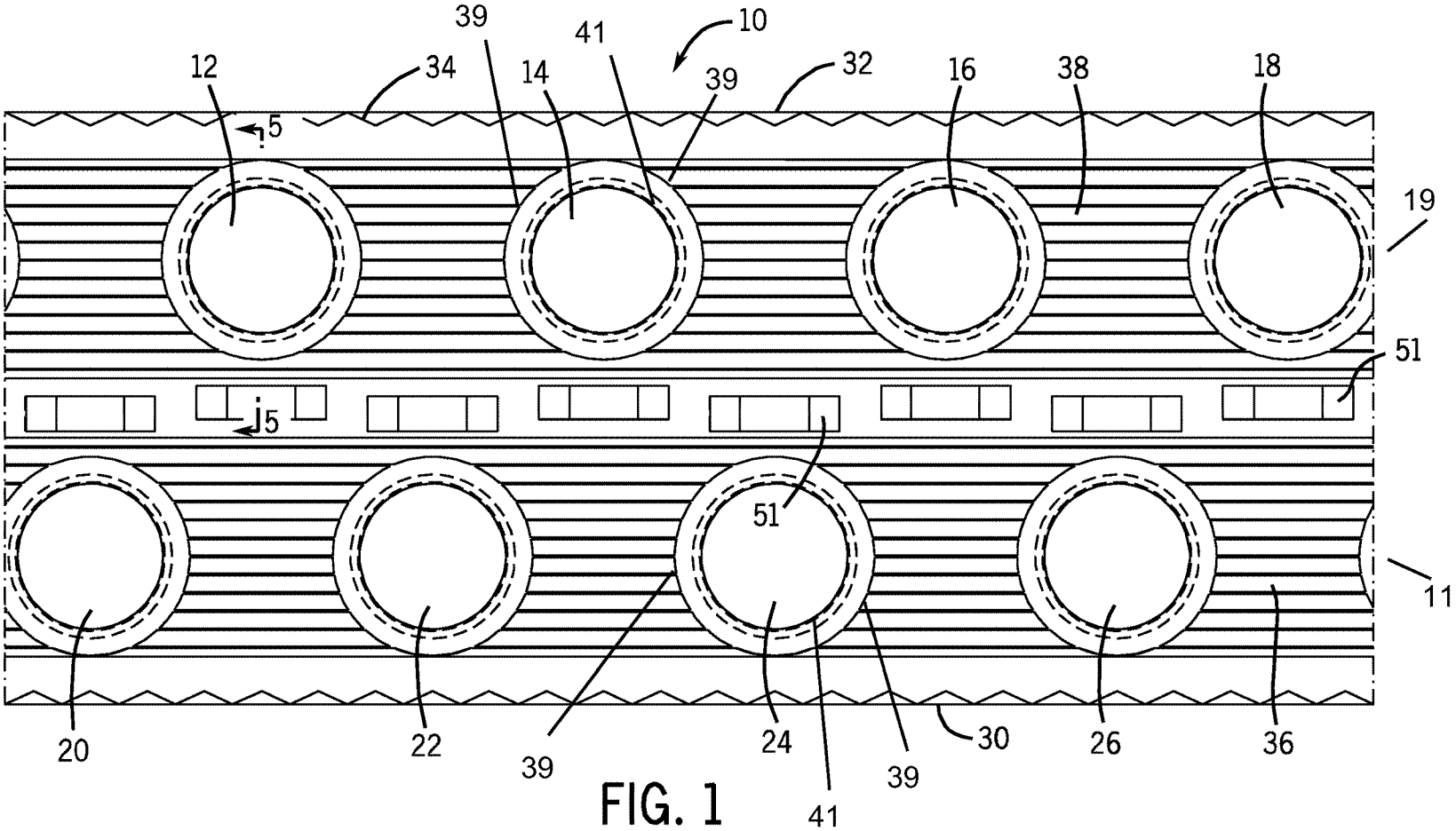
FIG. 1 is a plan view of a single, exemplary fin showing the louver layout and the tube openings.

Air coolers are generally known to those skilled in the art. They comprise cooling tubes disposed parallel to each other in rows and the rows being parallel to each other. A collection of fins are generally stacked parallel to each other with a typical, exemplary fin 10 shown in FIG. 1. Again, FIG. 1 is but a partial view of an exemplary fin for illustrative purposes to show a row of holes 12, 14, 16 and 18 for receiving tubes therethrough. A second parallel row of holes 20, 22, 24 and 26 for receiving tubes is also shown.

Edge 30 is the upstream or air inlet edge and edge 32 is the downstream or air outlet side. Advantageously, each illustrated edge has a series of bent triangular shapes 34 to add to the rigidity of the edges.

The upstream louvers are generally 36 and the downstream louvers are generally 38. These two louver banks 36, 38 align generally with and extend adjacent to a respective row of openings 11, 19 for tubes, and the louver banks 36, 38 generally define curved perimeters 39 tracking contours 41 of the openings 11, 19. This forces air that comes in between openings 24 and 26 to work its way around opening 16 since the tubes (not shown) that go in their respective holes are offset from one row to the next. The louvers can be punched out of the fin 10. As illustrated, they all extend above and below a fin but variations can be used where some or all louvers in the upstream bank 36 extend only from the top and some up to all louvers in bank 38 extend only from the bottom.

Figure 2:
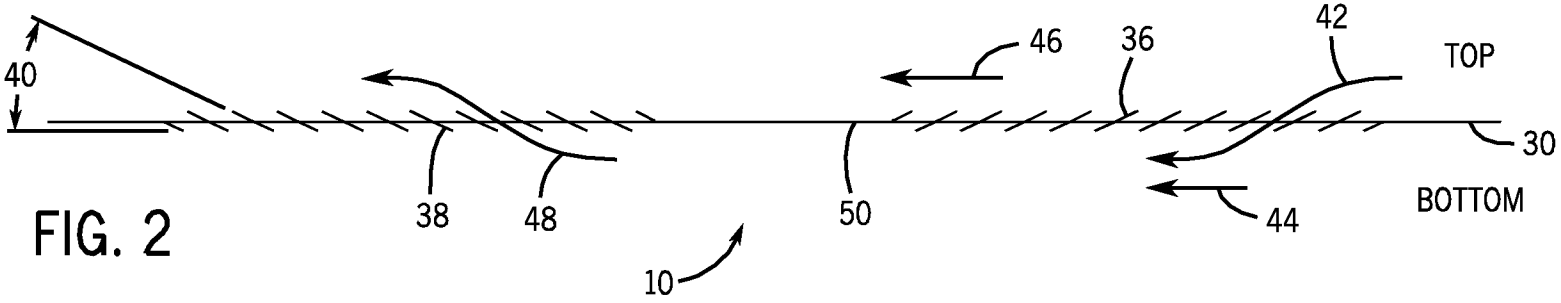
FIG. 2 is a section through the louvers in FIG. 1.

Now looking at FIG. 2, the orientation of the upstream louvers 36 and the downstream louvers 38 can more clearly be seen. As illustrated, both banks are at a common angle 40, such as 25°, with respect to fin 10 but in mirror image. As a result, the slope of the louvers in bank 36 is the negative of the louver slope in bank 38. The louvers in bank 36 extend above and below the planar surface of the fin 10, although some to all of the louvers could extend toward the region marked top in FIG. 2. In bank 38 the louvers extend above and below the planar surface of fin 10 but optionally some to all the louvers there could extend only in the region marked bottom in FIG. 2. As illustrated, the angle of inclination of each louver in a bank such as 36 or 38 is the same or close to the same as an adjacent louver in that bank. However, this inclination angle of the louvers within each bank may vary with respect to one another, if desired. The total dimension of the louver in a bank, as seen in FIG. 2, is the same or nearly the same, and this dimensioning may carry forward as being the same or nearly the same as between different banks that have negative slopes with respect to one another. However, it is worth noting that banks having varying dimensioning, with respect the banks and within the banks, are envisaged.

The desired effect at a single fin 10 is in part illustrated in FIG. 2. Air that comes in over edge 30 is shown entering in part by arrow 42. After engaging the louvers, it flows through them and toward the region labeled bottom where it can mix with entering air (arrow 44) coming in below fin 10. Some of the air stream 42 continues parallel to fin 10 as indicated by arrow 46. Eventually a portion of stream 44 that originated below fin 10 and parts of stream 42 directed below fin 10 engage the louvers in bank 38 and go back up above fin 10 (as indicated by arrow 48) now in general alignment with the cooling tubes (not shown) in openings 12-18. While flow around a single fin 10 is illustrated, those skilled in the art will appreciate that there are a plurality of fins like 10 above and below it whose spacing can be optimized to alter the tip to tip gap of louvers of adjacent fins thus regulating how big a portion of the incoming stream to a particular fin can pass straight through in the direction of arrow 44. Moreover, the width of the aperture defined by each louver or the width of each louver itself may be varied or maintained constant. Additionally, flow through the louvers from above represented by arrow 42 goes below the fin to make turbulent flow with the stream trying to get past under the louvers in bank 36. Similarly, any flow represented by arrow 46 has to mix with flow passing down through louvers in the next fin above fin 10. Thereafter as zone 50 is crossed, stream 46 encounters stream 48 coming up from below fin 10 for further mixing. These effects are repeated as between the pairs of adjacent fins 10. Spacers 5, which extend from the fin 10 surface to facilitate spacing of adjacent fins, can be optionally used in zone 50, for example. (See FIG. 1.) With respect to the orientation of FIG. 2, the first bank of louvers 36 are said to have a positive slope, while the second bank of louvers 38 have a negative slope, with the fin 10 defining the X-axis and with the Y-axis extending through a location between the first and second banks of louvers.

Figure 4:
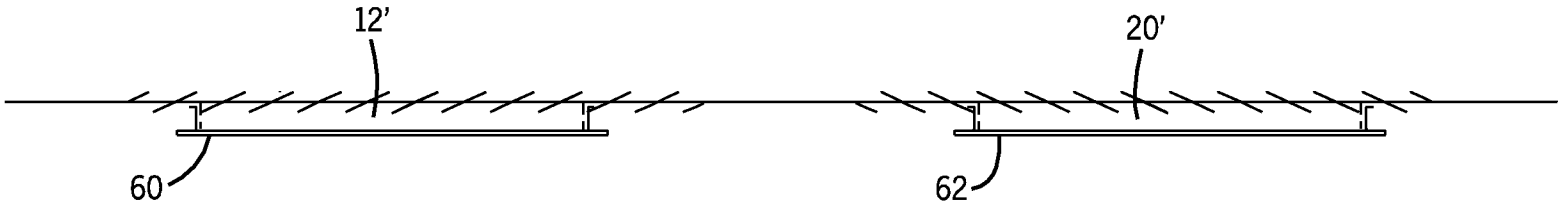
FIG. 4 is a section view through the louvers of FIG. 3.
Figure 3:
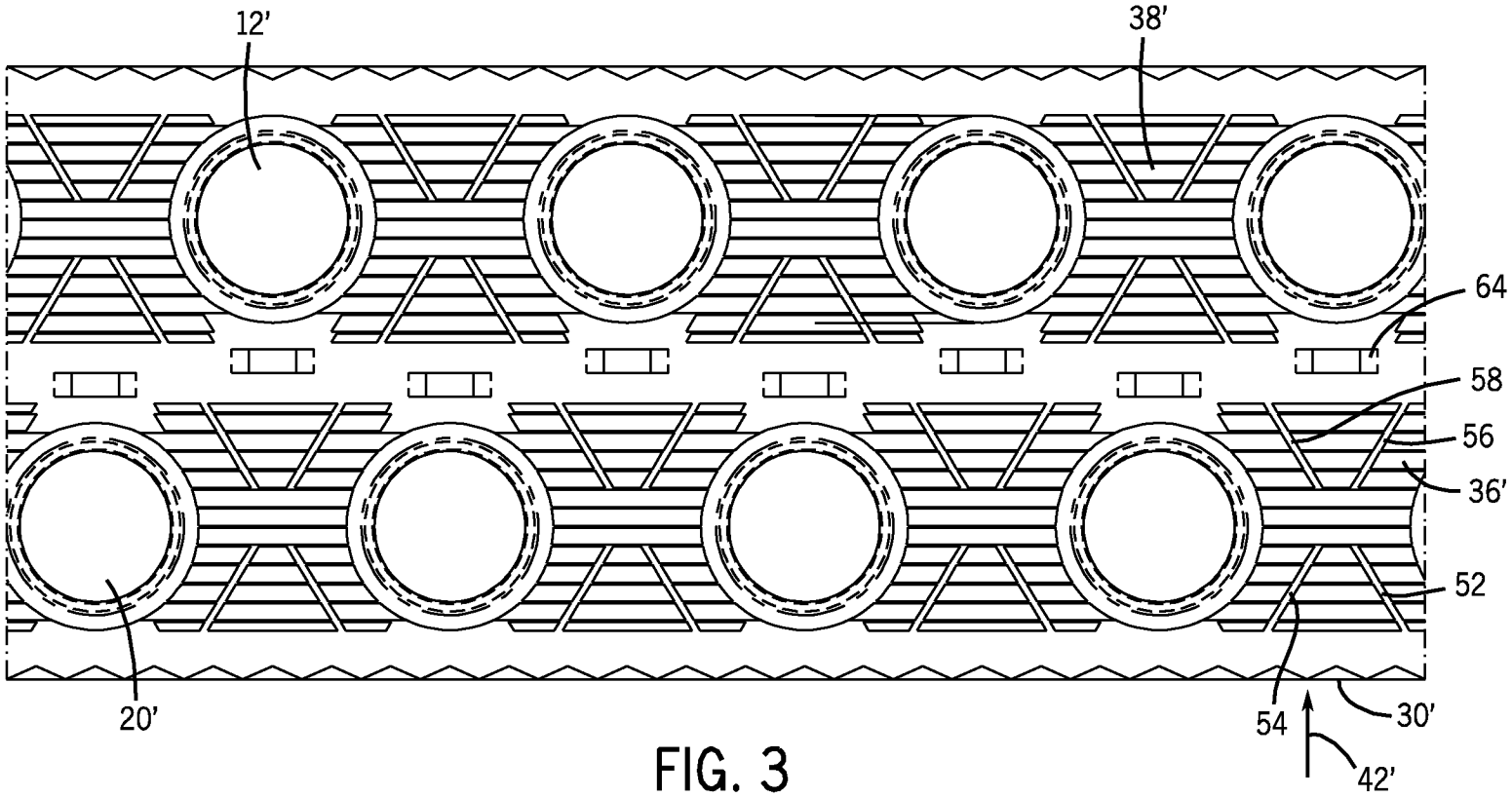
FIG. 3 is an alternative, exemplary embodiment to FIG. 1 using louvers of shorter widths and gaps between them in a given bank of tubes.
Figure 5:
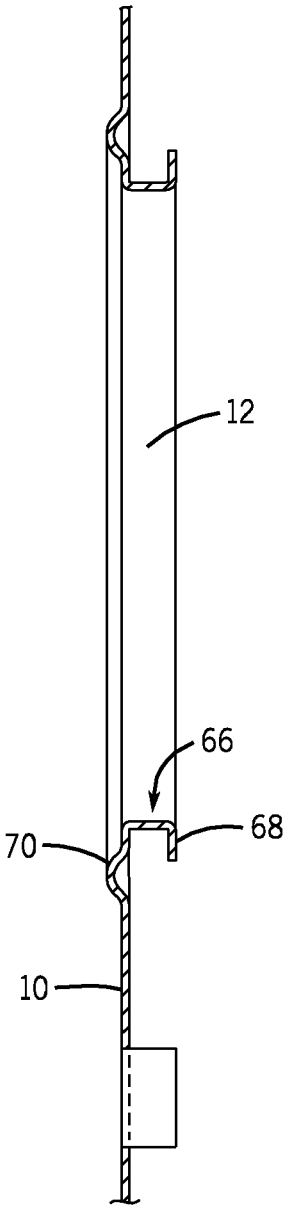
FIG. 5 is a detail around an opening for a tube.
Figure 6:
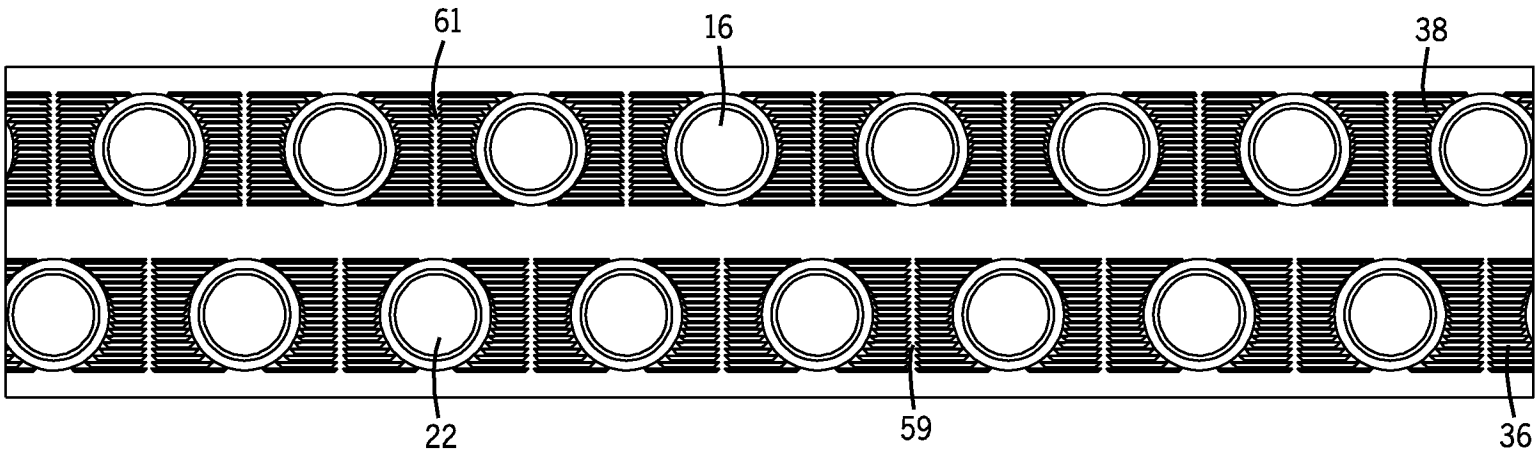
FIG. 6 is an alternative, exemplary embodiment to FIG. 3 showing a different gap layout in the louvers.

FIGS. 3 and 4 represent an alternative embodiment that in most ways is the same as FIGS. 1 and 2. One difference can be seen in banks 36' and 38'. Starting from edge 30', breaks 52 and 54 are illustrated as converging away from edge 30', in effect creating shorter louvers measured in a direction perpendicular to the incoming air as indicated by arrow 42'. In the same bank 36' two more breaks 56 and 58 diverge in the direction of incoming air shown by arrow 42'. Bank 38' can have the same treatment but offset from bank 36' due to the layout of the cooling tubes. Using shorter widths of leading and trailing louvers in a given bank tends to make such louvers stiffer and distort less when subjected to air flow conditions. An alternative is shown in FIG. 6 where a break 59 is aligned with the direction of air flow and with the tube in the bank behind it passing through, for example opening 16. Bank 38 can also have such breaks such as 61 that align with an opening such as 22 that is in front of it. Indeed, a variety of configurations for the breaks, such as convergence and divergence and angles therefor, are envisaged. Furthermore, FIG. 4 shows that openings such as 12' and 20' have raised flanges 60 and 62. Flanges 60 and 62 also act to maintain a predetermined distance between parallel fins. Optionally, spacers 64 shown in FIG. 3 and disposed between rows of holes can also be used to maintain the separation distance between fins 10. Referring to FIG. 5, a section through raised opening 66 is shown. It has a flange 68 spaced from and generally parallel to the plane of fin 10. A protrusion 70 is in or near the plane of the fin 10 and prevents warping of the fin 10 when a tube (not shown) is expanded into sealing contact with an opening such as 12.

Those skilled in the art will appreciate that changes can be made in the optimization process. What is optimized is a collection of variables that relate to cost, pressure drop, overall size and thermal performance. Commonality of patterns such as louver dimensions and angles saves cost; hence the preferred embodiment emphasizes such patterns. In the present invention the mixing of the air stream in an over, under and back to over pattern helps the thermal performance. Using planar fins saves cost. Spreading out the over, under and over pattern through two or more rows of tubes also promotes thermal performance and saves cost. The FIGS. 3 and 6 designs add strength to some of the louvers and reduce distortion from flexing or vibration from air flow and to some extent reduces pressure drop of the air.

Again, the above description is illustrative of exemplary embodiments, and many modifications may be made by those skilled in the art without departing from the invention whose scope is to be determined from the literal and equivalent scope of the claims below.

The invention claimed is:

1. A heat exchanger, comprising:

a plurality of rows of tubes intersecting a plurality of substantially planar fins, each of the fins comprising:

a first side;

a second side opposite the first side;

an upstream bank of louvers configured to direct fluid only from the first side of the fin to the second side of the fin as the fluid passes along the fin past at least a first row of the plurality of rows of tubes;

a first plurality of stiffening breaks disposed in the upstream bank of louvers, wherein the first plurality of stiffening breaks comprises a first plurality of converging stiffening breaks followed by a first plurality of diverging stiffening breaks, where the first plurality of stiffening breaks defines a first plurality of X-shaped stiffening breaks spaced between adjacent tubes in the at least a first row of the plurality of rows of tubes;

a downstream bank of louvers adjacent the upstream bank of louvers, wherein the downstream bank of louvers is configured to direct fluid only from the second side of the fin to the first side of the fin as the fluid passes along the fin past at least a second row of the plurality of rows of tubes, wherein all of the downstream bank of louvers are angled in a second sloping direction and protrude from both the first and second sides, wherein the first and second sloping directions are opposite from one another; and a second plurality of stiffening breaks disposed in the downstream bank of louvers, wherein the second plurality of stiffening breaks comprises a second plurality of converging stiffening breaks followed by a second plurality of diverging stiffening breaks;

wherein the upstream bank of louvers and/or the downstream bank of louvers further includes a region defined between the first and second plurality of stiffening breaks having at least one louver extending uninterrupted between an adjacent pair of tube holes, and wherein the at least one louver extends above and below the planar surface of the fin;

wherein the first plurality of converging stiffening breaks align with the first plurality of diverging stiffening breaks directly along first and second angled lines to define the first plurality of X-shaped stiffening breaks.

2. The heat exchanger of claim 1, wherein all the louvers in the upstream bank define a first slope in a first sloping direction with respect to the fin and all the louvers in the downstream bank define a second slope in the second sloping direction, wherein the second slope is the negative of the first slope.

3. The heat exchanger of claim 1, wherein all the louvers in at least one of the upstream or the downstream bank extend an equal distance from the first side or the second side of the fin.

4. The heat exchanger of claim 1, wherein the louvers are formed integrally with the fin to form a one-piece structure.

5. The heat exchanger of claim 1, wherein at least one end of the substantially planar fin is bent out of the plane of the fin to provide strength to the end, wherein the end is corrugated.

6. The heat exchanger of claim 1, comprising spacers configured to space adjacent fins at a predetermined distance from each other, wherein the spacers are disposed between adjacent banks.

7. The heat exchanger of claim 1, wherein the first plurality of louvers extends adjacent to the first row of the plurality of rows of tubes to define first curved perimeters tracking first contours of the first row of the plurality of rows of tubes, the second plurality of louvers extends adjacent to the second row of the plurality of rows of tubes to define second curved perimeters tracking second contours of the second row of the plurality of rows of tubes.

8. A heat exchanger, comprising:

a first row of cylindrical tubes;

a second row of cylindrical tubes;

a plurality of substantially planar fins arranged generally parallel to one another, wherein the plurality of substantially planar fins are separate from one another, wherein each fin of the plurality of substantially planar fins comprises:

a first row of cylindrical openings supporting the first row of cylindrical tubes;

a second row of cylindrical openings supporting the second row of cylindrical tubes;

a first plurality of louvers disposed along the first row of cylindrical openings supporting the first row of cylindrical tubes, wherein all of the first plurality of louvers are angled in a first sloping direction from the first row of cylindrical tubes toward the second row of cylindrical tubes, all of the first plurality of louvers protrude from a first common side of the fin, and the first plurality of louvers extends adjacent to the first plurality of cylindrical openings to define first curved perimeters tracking first contours of the first plurality of cylindrical openings;

a first plurality of stiffening breaks disposed in the first plurality of louvers, wherein the first plurality of stiffening breaks comprises a first plurality of converging stiffening breaks followed by a first plurality of diverging stiffening breaks;

a second plurality of louvers disposed along the second row of cylindrical openings supporting the second row of cylindrical tubes, wherein all of the second plurality of louvers are angled in a second sloping direction with a generally opposite slope relative to first plurality of louvers, all of the second plurality of louvers protrude from a second common side of the fin, and the second plurality of louvers extends adjacent to the second plurality of cylindrical openings to define second curved perimeters tracking second contours of the second plurality of cylindrical openings;

a second plurality of stiffening breaks disposed in the second plurality of louvers, wherein the second plurality of stiffening breaks comprises a second plurality of converging stiffening breaks followed by a second plurality of diverging stiffening breaks;

wherein the first plurality of louvers and/or the second plurality of louvers further includes a leading louver and a trailing louver, each of the leading and trailing louvers having a shorter width than an intermediate louver positioned between the converging stiffening breaks and the diverging stiffening breaks;

wherein the first plurality of stiffening breaks defines a first plurality of X-shaped stiffening breaks, and the second plurality of stiffening breaks defines a second plurality of X-shaped stiffening breaks; and wherein the first plurality of stiffening breaks and the second plurality of stiffening breaks are staggered relative to one another, wherein a first set of stiffening breaks in the first and second plurality of X-shaped stiffening breaks are directly aligned with one another along a first angled line, wherein a second set of stiffening breaks in the first and second plurality of X-shaped stiffening breaks are directly aligned with one another along a second angled line.

9. The heat exchanger of claim 8, wherein the first and second common sides are different from one another.

10. The heat exchanger of claim 8, wherein all of the first plurality of louvers protrude from both the first common side and the second common side of the fin, all of the second plurality of louvers protrude from both the first common side and the second common side of the fin.

11. The heat exchanger of claim 8, wherein each of the first plurality of cylindrical openings comprises a first cylindrical flange protruding from the fin, and each of the second plurality of cylindrical openings comprises a second cylindrical flange protruding from the fin.

12. A heat exchanger, comprising:

a first row of cylindrical tubes;

a plurality of substantially planar fins arranged generally parallel to one another, wherein the plurality of substantially planar fins are separate from one another, wherein each fin of the plurality of substantially planar fins comprises: a first row of cylindrical openings supporting the first row of cylindrical tubes;

a first plurality of louvers disposed along the first row of cylindrical openings supporting the first row of cylindrical tubes, wherein all of the first plurality of louvers are angled in a first sloping direction and protrude from a first common side of the fin, and the first plurality of louvers extends adjacent to the first plurality of cylindrical openings to define first curved perimeters tracking first contours of the first plurality of cylindrical openings;

a first plurality of stiffening breaks disposed in the first plurality of louvers, wherein the first plurality of stiffening breaks comprises a first plurality of converging stiffening breaks followed by a first plurality of diverging stiffening breaks, wherein the first plurality of stiffening breaks defines a first plurality of X-shaped stiffening breaks spaced between pairs of adjacent first curved perimeters in the first plurality of louvers; and wherein the first plurality of louvers include at least one louver extending uninterrupted between one tube opening and an adjacent tube opening as well as between the first plurality of converging stiffening breaks and the first plurality of diverging stiffening breaks, and wherein the at least one louver extends above and below the planar surface of each of the fins;

wherein the first plurality of converging stiffening breaks align with the first plurality of diverging stiffening breaks directly along first and second angled lines to define the first plurality of X-shaped stiffening breaks.

13. The heat exchanger of claim 12, comprising:

a second row of cylindrical tubes;

a second row of cylindrical openings supporting the second row of cylindrical tubes;

a second plurality of louvers disposed along the second row of cylindrical openings supporting the second row of cylindrical tubes, wherein all of the second plurality of louvers are angled in a second sloping direction and protrude from a second common side of the fin, the second plurality of louvers extends adjacent to the second plurality of cylindrical openings to define second curved perimeters tracking second contours of the second plurality of cylindrical openings, and the first and second sloping directions are opposite from one another; and a second plurality of stiffening breaks disposed in the second plurality of louvers, wherein the second plurality of stiffening breaks comprises a second plurality of converging stiffening breaks followed by a second plurality of diverging stiffening breaks.

14. A heat exchanger, comprising:

a first row of cylindrical tubes;

a plurality of substantially planar fins arranged generally parallel to one another, wherein the plurality of substantially planar fins are separate from one another, wherein each fin of the plurality of substantially planar fins comprises:

a first row of cylindrical openings supporting the first row of cylindrical tubes;

a first plurality of louvers disposed along the first row of cylindrical openings supporting the first row of cylindrical tubes, wherein all of the first plurality of louvers are angled in a first sloping direction and protrude from a first common side of the fin, and the first plurality of louvers extends adjacent to the first plurality of cylindrical openings to define first curved perimeters tracking first contours of the first plurality of cylindrical openings; and a first plurality of stiffening breaks disposed in the first plurality of louvers, wherein the first plurality of stiffening breaks comprises a first plurality of converging stiffening breaks that extend through all of a first sequence of louvers in the first plurality of louvers on the first common side of the fin, wherein the first plurality of stiffening breaks comprises a first plurality of diverging stiffening breaks that extend through all of a second sequence of louvers in the first plurality of louvers on the first common side of the fin, wherein the first plurality of converging stiffening breaks align with the first plurality of diverging stiffening breaks directly along first and second angled lines to define a first plurality of X-shaped stiffening breaks spaced directly between pairs of adjacent first curved perimeters in the first plurality of louvers.

15. The heat exchanger of claim 14, wherein each fin of the plurality of substantially planar fins comprises:

a second row of cylindrical openings supporting a second row of cylindrical tubes;

a second plurality of louvers disposed along the second row of cylindrical openings supporting the second row of cylindrical tubes, wherein all of the second plurality of louvers are angled in a second sloping direction and protrude from a second common side of the fin, the second plurality of louvers extends adjacent to the second plurality of cylindrical openings to define second curved perimeters tracking second contours of the second plurality of cylindrical openings, wherein the first and second sloping directions are opposite from one another; and a second plurality of stiffening breaks disposed in the second plurality of louvers, wherein the second plurality of stiffening breaks comprises a second plurality of converging stiffening breaks that extend through all of a third sequence of louvers in the second plurality of louvers, wherein the second plurality of stiffening breaks comprises a second plurality of diverging stiffening breaks that extend through all of a fourth sequence of louvers in the second plurality of louvers, wherein the second plurality of converging stiffening breaks align with the second plurality of diverging stiffening breaks directly along third and fourth angled lines to define a second plurality of X-shaped stiffening breaks spaced directly between pairs of adjacent second curved perimeters in the second plurality of louvers.

16. The heat exchanger of claim 15, wherein all of the first plurality of louvers protrude from both the first common side and the second common side of the fin, and wherein all of the second plurality of louvers protrude from both the first common side and the second common side of the fin.

* * * * *